United States Patent [19]

Hemme

[11] 3,990,518

[45] Nov. 9, 1976

[54] AUTOMATIC FIRE ALARM AND EXTINGUISHER DEVICE

[75] Inventor: Friedrich Hemme, Zell, Germany

[73] Assignee: Siemens Aktiengesellschaft, Berlin & Munich, Germany

[22] Filed: May 13, 1975

[21] Appl. No.: 576,956

[30] Foreign Application Priority Data

May 14, 1974 Germany ..... 2423447

[52] U.S. Cl. ..... 169/60; 169/16; 340/237 S; 340/418

[51] Int. Cl.[2] ..... A62C 37/18; G08B 19/00

[58] Field of Search ..... 169/60, 61, 16; 340/237 S, 418, 237 R

[56] References Cited

UNITED STATES PATENTS

| | | | |
|---|---|---|---|
| 2,509,497 | 5/1950 | Hesson | 340/237 S |
| 3,255,441 | 6/1966 | Goodwin et al. | 340/237 S |
| 3,447,152 | 5/1969 | Jensen | 340/237 S |
| 3,469,250 | 9/1969 | Voigt | 340/237 S |
| 3,605,901 | 9/1971 | Grabowski et al. | 169/16 X |
| 3,702,158 | 11/1972 | Livingston et al. | 169/16 X |
| 3,750,161 | 7/1973 | Teeters | 340/418 |
| 3,773,145 | 11/1973 | Drexler | 340/237 S |
| 3,835,931 | 9/1974 | Livingston | 169/16 X |
| 3,865,192 | 2/1975 | Dunphy | 169/61 |
| 3,866,687 | 2/1975 | Banner | 169/61 |

*Primary Examiner*—Robert S. Ward, Jr.
*Attorney, Agent, or Firm*—Hill, Gross, Simpson, Van Santen, Steadman, Chiara & Simpson

[57] ABSTRACT

An automatic fire alarm and extinguisher device in the form of a fire protection unit comprising fire alarm means, preferably a smoke alarm and a heat or flame alarm, valve means for controlling an extinguisher fluid, means for controlling the valve means in response to action of the respective alarms, all of which is disposed in a common protective housing, and at least one extinguisher fluid outlet head. The unit may be connected to a central station over a monitored line and where a plurality of outlet heads are employed for respective adjacent zones, the zones, by suitable disposition of the outlet heads, may overlap.

9 Claims, 5 Drawing Figures

AUTOMATIC FIRE ALARM AND EXTINGUISHER DEVICE

BACKGROUND OF THE INVENTION

The invention relates to an automatic fire alarm and extinguisher structure having at least one outlet nozzle or head for discharge of an extinguisher fluid, the supply of which may be controlled by means of a valve, in dependence upon the operating condition of at least one fire alarm.

Known automatic extinguisher systems have the great advantage that upon the presence of the required actuating conditions, they respond immediately to combat the fire. On the other hand, they possess the disadvantage that the extinguishing operation occurs normally at a relatively late time and that frequently the extinguishing fluid, usually water, continues to be discharged until the arrival of the fire department, whereby excess water can cause considerable damage. The first-mentioned disadvantage can be reduced by controlling the extinguisher system by means of an early-warning fire alarm, for example, an ionization smoke alarm.

Controlled extinguisher devices have been known in which, following the response of fire alarms in two different lines, the extinguisher system is triggered. Expensive electro-technical installations are required, as are suitable monitoring devices for the extinguisher fluid valves. However, the extinguishing operation is not terminated once the extinguishing operation is initiated, the extinguishing operation being continued until the arrival of the fire department, or terminated following a predetermined period of time. However, in the latter instance, fire may flare up again after the extinguishing operation, which is not detected and can dangerously develop.

In an effort to overcome the last-mentioned problem, it has heretofore been proposed to constantly monitor the operation of the extinguisher at specific time intervals by means of a flame alarm and to effect discharge of an additional quantity of extinguisher fluid as long as such flame alarm is actuated. However, in such a solution, there remains the problem of installing a line to the central control and to the extinguisher valve means for each fire alarm and to monitor these respective lines.

BRIEF DESCRIPTION OF THE INVENTION

The invention has as its objective the reduction in the installation outlay, and, at the same time, insure a high degree of reliability of the system with a minimum of expense.

This objective is achieved, in accordance with the invention, by the utilization of fire alarms which are assigned to respective monitoring zones and combining the same, together with the valves for extinguisher fluid to be controlled thereby, and the associated control devices, in a common protective housing.

The utilization of a single unit for the alarm equipment and the extinguisher control equipment enables the elimination of monitoring devices between such systems, whereby each monitored zone contains a single compact fire protection device which is connected over a single monitored path to the central control, and contains all of the detectors together with the extinguisher fluid control valve and the entire control circuitry.

Normally a fire protection unit, constructed in accordance with the invention, will contain two fire detectors, one an early-warning alarm, such as a smoke alarm for the initial triggering of the extinguisher device, and an additional second fire alarm for the subsequent control of the operation of the extinguisher device. The second alarm can, for example, be a flame alarm or a heat alarm, it being important that it is of a type that will not respond to smoke, water vapor and similar consequent condition following the fire and the extinguishing operation. In dependence upon the particular circumstances, it is possible to eliminate an early detection by means of a smoke alarm or the like, and to employ only a single fire alarm which, for example, may be in the form of a flame or heat alarm and which initiates both the first operation as well as any subsequent operation of the extinguisher device.

The extinguisher fluid supply line leads from a supply container to the fire protection unit of the invention and from there to the individual extinguisher outlet nozzles or heads associated with the specific unit.

In a further embodiment of the invention the extinguisher fluid nozzle or head may be incorporated with the fire protection unit and thus associated directly with the protective housing thereof. However, normally a relatively larger area will be covered than could be accommodated by a single extinguisher nozzle and in this case it is desirable that the extinguishing areas of the individual fire protection units overlap slightly, providing an initial protection in an adjacent zone before the fire can reach the same to trigger the alarms associated with such adjacent zone, and thus avoid a progressive action such as occurs in conventional sprinkler systems.

BRIEF DESCRIPTION OF THE DRAWINGS

In the drawings wherein like reference characters indicate like or corresponding parts.

DETAILED DESCRIPTION OF THE INVENTION

Figure 1:
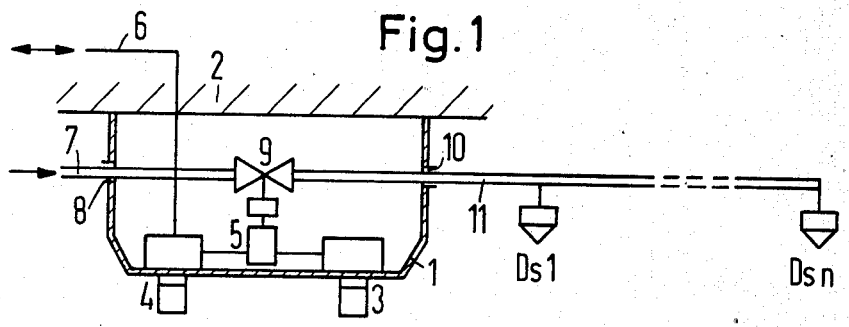
FIG. 1 illustrates schematically a fire protection unit in accordance with the present invention.

Referring to the drawings and more particularly to FIG. 1, there is illustrated a fire protection unit in accordance with the invention, which comprises a protective housing 1 adapted to be mounted on the ceiling 2 of the space to be protected. Disposed in the housing is a smoke alarm 3 and the flame or heat alarm 4, the fire sensing elements of which project through suitable openings in the housing as illustrated, with both fire alarms being connected to a common logic linking circuit 5, as well as to a central station or control over monitored line 6, which line forms the only connection line which requires special protection and monitoring. Normally, the line 6 will also contain the current supply lines for the fire protection unit.

Extinguisher fluid may be provided over a supply line 7 which extends through an inlet 8 in the protective housing 1, and is operatively connected to a magnetic valve 9 adapted to be controlled by means of the logic linking circuit 5 in dependence upon the operating states of the fire alarms 3 and 4, i.e. the valve being either open or closed thereby. The extinguisher fluid is conducted from the magnetic valve 9 through outlet 10 in the protective housing 1, and over a line 11 to respective individual extinguisher nozzles or heads D*s*1 to D*sn*, one of which can be disposed in the housing, but need not necessarily be so disposed.

Figure 2:
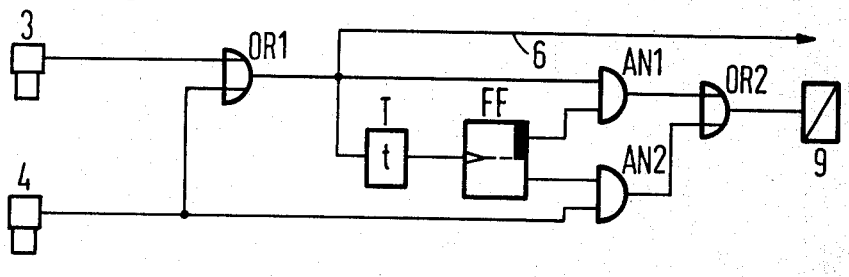
FIG. 2 is a simple block circuit diagram of such a fire protection unit.

FIG. 2 illustrates the logic linking of the two fire alarms 3 and 4 to the associated valve actuating unit, the circuit being illustrated in simplified form. If one of the two fire alarms 3 or 4 is actuated, a signal is supplied over the OR gate 1 as well as over line 6 to the central control or station, with the magnetic valve 9 being actuated to open position over the AND gate AN1 and the OR gate OR2. Simultaneously therewith a time element T is initially actuated which is operative after a predetermined length of time to trigger the flip-flop FF. As a result, the AND gate AN1 is blocked and the AND gate AN2 prepared. Consequently, the magnetic valve 9 will thereafter be closed unless, in the meantime, the flame alarm 4 has been actuated to continue actuation of the valve 9 over AND gate AN2 and OR gate OR2.

In most cases the initial response will be produced by the ionization smoke alarm 3 before fire has openly broken out in the form of flames. However, subsequently, i.e. at the end of the time cycle as determined by the time element T the ionization fire alarm 3 will have no further influence on the operation of the magnetic valve 9. Consequently, vapors and the like which might otherwise cause the early-warning alarm to remain in an actuated state of alarm will have no effect. At the end of the time period, as determined by the time element T, the flame alarm 4 will thereafter have sole control of the magnet valve 9 which it actuates on and off in dependence on whether the extinguishing operation is or is not successful.

Figure 3:
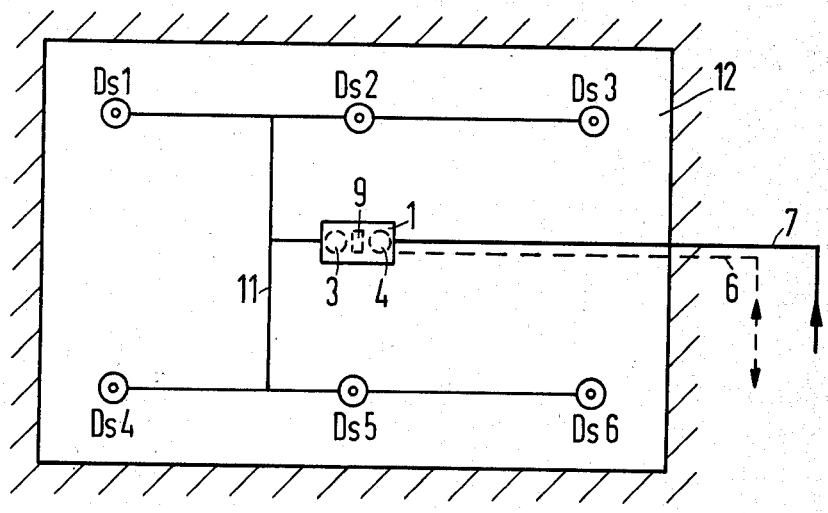
FIG. 3 is a diagrammatic plan illustrating the spatial distribution of a fire protection unit and associated extinguisher nozzles or heads.

FIG. 3 schematically illustrates the spatial arrangement of a fire protection unit, i.e. fire alarm and extinguisher unit, with respect to the associated nozzles or heads controlled thereby. The protective housing 1 containing the smoke alarm (ionization alarm) 3 and the flame or heat alarm 4, as well as the magnet valve 9, is disposed approximately in the center of the space 12 to be protected. The housing is connected to the central control over the monitored signal line 6 and is similarly connected to the extinguisher fluid supply, for example a water line, over supply line 7. The respective nozzles or heads D*s*1 to D*s*6 are supplied over lines 11.

Figure 4:
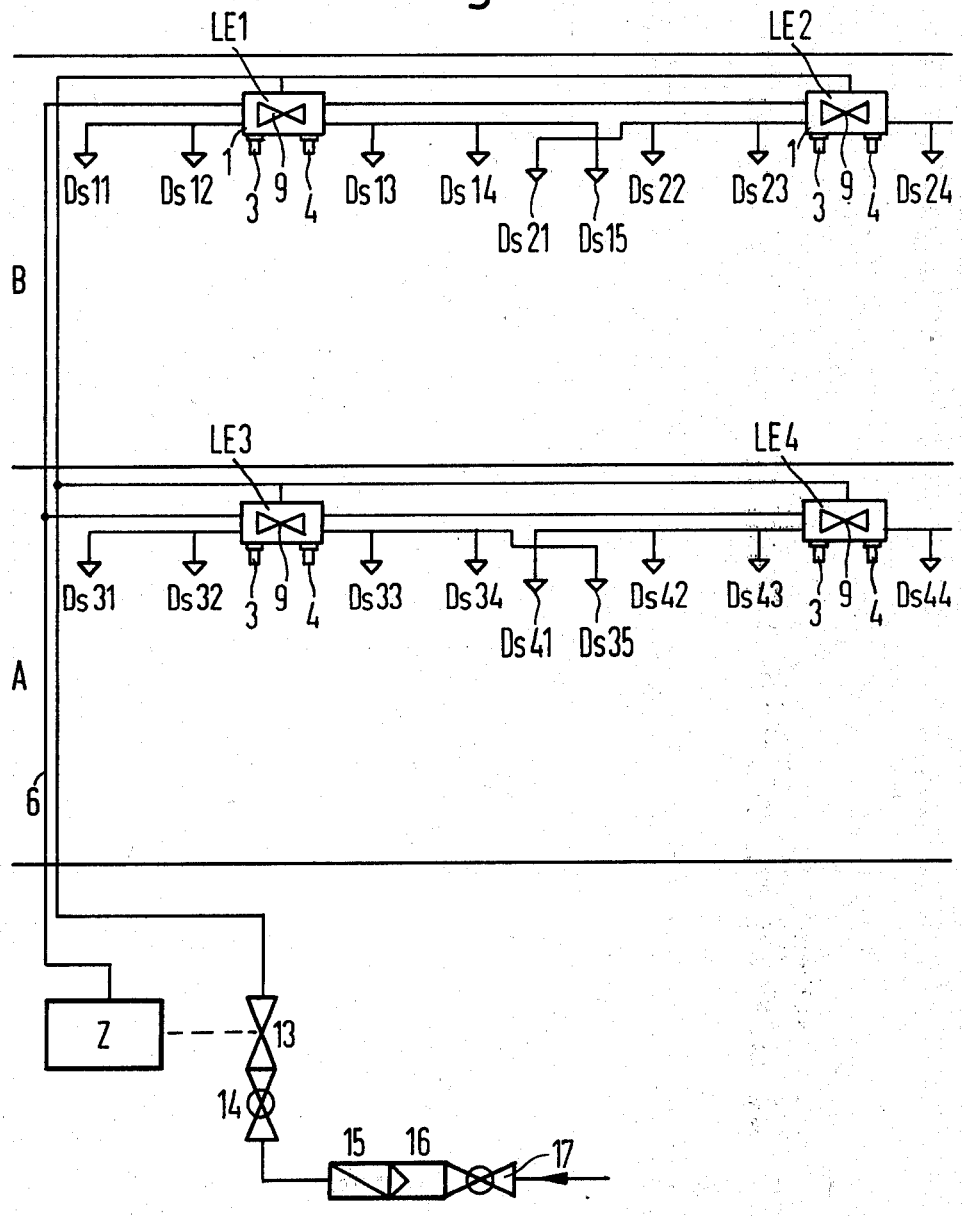
FIG. 4 illustrates a fire alarm and extinguisher system utilizing a plurality of fire protection units.

FIG. 4 schematically illustrates the construction of a larger fire alarm and extinguisher system, as applied to two monitored spaces A and B, each of which contain a fire protective unit. Each of such units is constructed in accordance with the invention as previously described with the respective protective housings 1, each containing two different fire alarms 3 and 4, magnetic valve 9, etc. Each unit supplies a specific number of extinguisher nozzles or heads, for example the unit LE1 supplying the nozzles D*s*11 to D*s*15, while the unit LE2 supplies nozzles or heads D*s*21 to D*s*24, etc. As illustrated, the individual extinguisher heads at the peripheries of the zones controlled by the respective units are in overlapping relation whereby the extinguisher head D*s*21 is disposed in the zone of the extinguisher heads D*s*14 and D*s*15. As a result of this construction upon actuation of a unit, the peripheral area of the adjacent zone is also wetted down by operation of the previous unit so that the progressive action normally experienced with the usual type of sprinkler system is avoided.

The individual extinguisher units are operatively connected to a central control or station Z over the line 6. The extinguisher fluid supply likewise may take place from a central valve station 13 in conjunction with a shut off gate valve 14. The valve station is supplied over a check valve 15 and a stone or particle remover 16 which is supplied from a central water supply line over a further shut off valve 17.

When a different type of extinguisher fluid is employed, the extinguisher units will be suitably coupled to the particular extinguisher fluid supply involved.

Figure 5:
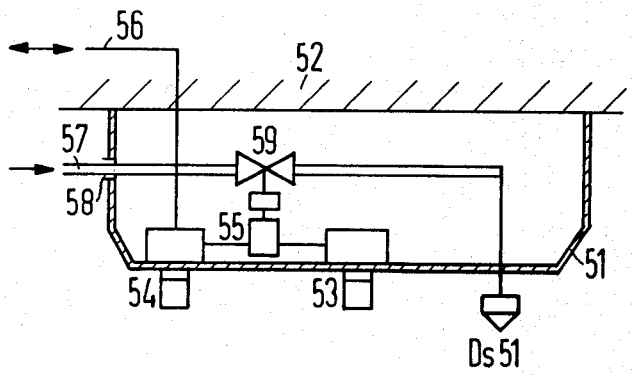
FIG. 5 is a figure similar to FIG. 1, illustrating a modified form of fire protection unit.

FIG. 5 illustrates a modified form of extinguisher unit which generally corresponds to that illustrated in FIG. 1, with the housing 51 being mounted on a ceiling 52 and containing a suitable smoke alarm 53 and flame alarm 54, connected by a logic linking circuit 55, with the circuits being operatively connected to the central station by a monitored line 56. The linking circuit 55 controls the actuation of the magnetic valve 59, and is operatively connected to an extinguisher fluid supply line 57 which extends through the inlet opening 58 in the housing 51. However, in this construction the valve 59 controls an extinguisher nozzle or head D*s*51 which is carried by the housing 51. While this type of construction would normally involve a small area, in some instances it may be employed with other extinguisher nozzles or heads operatively connected to the magnetic valve 59.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In an automatic fire alarm and extinguisher device forming part of a fixed relatively permanent central fire alarm and extinguisher system which includes a central station and a common central supply of extinguisher fluid for a plurality of extinguisher outlet heads operatively connected thereto over fixed piping, the combination of a unitary fire protection unit adapted to monitor a predetermined zone, comprising alarm means operatively connected to the central station by a fire-protected, monitored electric line, a valve, operatively connected by fixed piping to said central fluid supply, and control means operatively connecting said alarm means and said valve for opening said valve upon predetermined operation of said alarm means, a protective housing of a size to operatively contain primarily only said valve and said alarm and control means, and at least one extinguisher outlet head, remote from said housing and said valve, and operatively connected thereto only by fixed piping which extends from said housing to said head.

2. A device according to claim 1, wherein said alarm means comprises a smoke detector and a heat or flame detector, which are accommodated in the common protective housing.

3. A device according to claim 1, wherein an additional extinguisher outlet head also is provided, the protective housing being of a size to also operatively support such additional extinguisher outlet head, as well as piping operatively connecting such additional head and said valve.

4. A device according to claim 1, wherein a plurality of extinguisher outlet heads are provided, covering a specific extinguishing zone, which are supplied in common from the valve means disposed in the protective housing over relatively fixed piping.

5. A device according to claim 4, wherein respective extinguisher zones are provided, each of which has its own respective fire protection unit and a plurality of extinguisher outlet heads, which zones operatively overlap, as a result of the arrangement of the individual extinguisher outlet heads of the respective zones, whereby the overlapping area of the zones is protected by at least one outlet head of each of such zones.

6. A device according to claim 5, wherein said alarm means comprises a smoke alarm and a heat or flame alarm, which are accommodated in the common protective housing and operatively connected over said monitored line to such central station.

7. A device according to claim 5, wherein an additional extinguisher outlet head also is provided, the protective housing being of a size to also operatively support such additional extinguisher outlet head, as well as piping operatively connecting such additional head and said valve.

8. A device according to claim 2, wherein an additional extinguisher outlet head also is provided, the protective housing being of a size to also operatively support such additional extinguisher outlet head, as well as piping operatively connecting such additional head and said valve.

9. A device according to claim 2, wherein said control means comprises means responsive to the actuation of said smoke detector to initially open said valve, and timing means operative to effect, in the absence of interim actuation of the flame or fire detector, a closing of said valve after a predetermined time period, and to place said valve under the sole control of the flame or fire detector whereby the latter thereafter determines the open or closed state of said valve.

* * * * *